US008330081B2

(12) United States Patent
Dimmick et al.

(10) Patent No.: US 8,330,081 B2
(45) Date of Patent: Dec. 11, 2012

(54) FILAMENT HEATING DEVICE FOR AN OPTICAL FIBER AND RELATED METHODS

(75) Inventors: Timothy Eugene Dimmick, Oviedo, FL (US); Eric Karl Johnson, West Melbourne, FL (US); Brian Edward Simpson, Sebastian, FL (US); Mark Alan Trautman, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 672 days.

(21) Appl. No.: 12/545,589

(22) Filed: Aug. 21, 2009

(65) Prior Publication Data

US 2011/0042367 A1 Feb. 24, 2011

(51) Int. Cl.
*F27B 14/00* (2006.01)

(52) U.S. Cl. ..... 219/424

(58) Field of Classification Search ..... None
See application file for complete search history.

(56) References Cited

U.S. PATENT DOCUMENTS

| | | | | |
|---|---|---|---|---|
| 4,049,414 | A * | 9/1977 | Smith | 65/407 |
| 4,336,047 | A | 6/1982 | Pavlopoulos et al. | 65/3.31 |
| 4,377,403 | A | 3/1983 | McLandrich | 65/3.11 |
| 4,484,794 | A | 11/1984 | Witte | |
| 4,490,163 | A * | 12/1984 | Jochem et al. | 65/408 |
| 4,584,464 | A * | 4/1986 | Myer | 392/417 |
| 4,869,570 | A | 9/1989 | Yokohama et al. | |
| 4,879,454 | A | 11/1989 | Gerdt | 219/494 |
| 4,958,905 | A | 9/1990 | Tynes et al. | |
| 5,111,015 | A * | 5/1992 | Riordan | 219/56.22 |
| 5,168,145 | A * | 12/1992 | Tackett et al. | 219/243 |
| 5,217,517 | A | 6/1993 | Rossberg | 65/4.21 |
| 5,342,425 | A * | 8/1994 | Rowe et al. | 65/501 |
| 5,698,124 | A * | 12/1997 | DiMarcello et al. | 219/635 |
| 5,718,109 | A * | 2/1998 | Fujita | 57/290 |
| 6,207,922 | B1 * | 3/2001 | Dumitriu et al. | 219/121.45 |
| 6,336,750 | B1 | 1/2002 | Clark et al. | 385/96 |
| 6,701,046 | B1 | 3/2004 | Pianciola et al. | 385/43 |
| 6,862,386 | B2 | 3/2005 | Corio et al. | 385/43 |
| 6,994,481 | B2 | 2/2006 | Chi et al. | 385/96 |
| 7,003,985 | B2 * | 2/2006 | Swain et al. | 65/473 |
| 7,104,706 | B2 * | 9/2006 | Bergstrsom et al. | 385/99 |
| 7,212,718 | B2 * | 5/2007 | Sato | 385/134 |
| 7,266,259 | B1 | 9/2007 | Sumetsky | 385/12 |
| 7,364,375 | B1 * | 4/2008 | Jones | 385/99 |
| 2008/0022726 | A1 | 1/2008 | Harper et al. | 65/435 |

OTHER PUBLICATIONS

Birks, et al., "The Shape of Fiber Tapers," Journal of Lightwave Technology, vol. 10, pp. 432-438, Apr. 1992.

Kakarantzas, et al., "Fabrication of High Performance Fibre Tapers and Couplers using a $CO_2$ Laser Rig," WB1/CLEO/Pacific Rim '99, pp. 127-128.

MHI, Inc., MicroFiber Heater Part Number: FibHeat 200, http://www.mhi-inc.com/PG4/fiber-hearter-micoheater.html, 2000-2009.

Vytran, Data Sheet FFS-2000, Filament Fusion Splicing Workstation.

* cited by examiner

*Primary Examiner* — Scott B Geyer

(74) *Attorney, Agent, or Firm* — Allen, Dyer, Doppelt, Milbrath & Gilchrist, P.A.

(57) ABSTRACT

A heating device for an optical fiber may include a crucible body having an optical fiber receiving slotted passageway therein for receiving the optical fiber therein, and a heating element receiving passageway therein adjacent the optical fiber receiving slotted passageway and spaced apart therefrom. The heating device may include a respective electrically powered resistance heating element enclosed within the heating element receiving passageway for heating the optical fiber within the optical fiber receiving slotted passageway.

40 Claims, 8 Drawing Sheets

FILAMENT HEATING DEVICE FOR AN OPTICAL FIBER AND RELATED METHODS

FIELD OF THE INVENTION

The present invention relates to the field of optical fiber heating devices, and, more particularly, to an optical fiber filament heating device and related methods.

BACKGROUND OF THE INVENTION

Communication is an integral part of modern society and provides the backbone of many services used on a day-to-day basis. An important component of any communication system is the transmission medium. Initially, such mediums of communication were accomplished using traditional metallic cables.

As the demands on the communication mediums have increased and with the advent of digital high bandwidth communications, it became desirable to make communication mediums that experienced lower loss, carried more data, and required less power to operate. One such approach to a low loss, high bandwidth communication medium is the optical fiber. The optical fiber provides an advantageous communication medium since it experiences less loss, can carry much more data per second than the typical metallic wire, and is immune to electromagnetic interference.

As fiber optic applications have become more prevalent, optical fibers are used in many complex devices and systems. In these applications, it is often desirable to couple optical fibers together, i.e. directing a portion of the light propagating in one optical fiber into another. This coupling may take the form of a simple broadband coupler of a fixed coupling ratio or, for more sophisticated wavelength division multiplexed fiber optic communication systems, a wavelength selective coupler that can be used to divert certain wavelength signals onto one fiber while leaving the remaining wavelength signals on the original fiber. A typical device used in these systems for coupling light between optical fibers is the fused fiber coupler. The fused fiber coupler is formed by placing two optical fibers in contact with one another and elongating the fibers while applying heat sufficient to soften the fibers. For example, U.S. patent application Ser. No. 11/473,689 to Harper et al., also assigned to the present application's assignee, discloses a method for controlling the shape of the fused fiber coupler through coordinated motion of a short heat source and an elongation apparatus.

An element of any optical fiber coupling/tapering system is the optical fiber heater. For example, the optical fiber heater may comprise a crucible including a heating element therein. Of course, the heating element must achieve a temperature within the crucible that exceeds the point at which silica ($SiO_2$) is viscous, which is 1000° C. (1832° F.) (silica melting point 1650° C. (3002° F.)). The crucible includes an opening for receiving the optical fiber. The optical fiber is heated therein and drawn for tapering thereof. For coupling, two or more optical fibers are inserted through the opening and are held in contact with one another for fusion. Advantageously, optical fiber heaters that heat a short length (<3 mm) of optical fiber are desirable for fabricating high performance fiber optic devices.

An approach to optical fiber heaters is the flame based optical fiber heater, for example, as disclosed in U.S. Pat. No. 4,869,570 to Yokohama et al. The flame may be generated using Hydrogen or Deuterium, for example. Another approach to optical fiber heaters is the laser based optical fiber heater, for example, as disclosed in U.S. Pat. No. 7,266,259 to Sumetsky. In this approach, the optical fiber is heated indirectly using a carbon dioxide ($CO_2$) laser to heat a sapphire tube through which the optical fiber is threaded.

An approach to optical fiber heaters is the filament based optical fiber heater, for example, as disclosed in U.S. Pat. No. 4,336,047 to Pavlopoulos et al. Using the same principle as filament based light bulbs, this heating device runs an electrical current through a tungsten filament in an argon atmosphere with the optical fiber directly exposed to the tungsten filament. Another approach to filament based optical fiber heaters is disclosed in U.S. Pat. No. 4,879,454 to Gerdt. This optical fiber heater uses several platinum filaments in an alumina support structure to radiatively heat the optical fiber. In this approach, the optical fiber is directly exposed to the platinum filament. Another approach to electric resistance based optical fiber heaters is disclosed in U.S. Pat. No. 6,701,046 to Pianciola et al. This optical fiber heater uses a cylindrical platinum crucible that is heated by radio frequency (RF) induction.

Another example of an electric resistance based optical fiber heater is available from the Micropyretics Heaters International Inc. of Cincinnati, Ohio and includes the typical crucible having an opening and a heating element therein. The heating element comprises an electric resistance heating element made from molybdenum disilicide. The crucible is made from a cast ceramic with the molybdenum disilicide heating element cast within the crucible body Another approach to optical fiber heaters is the plasma based optical fiber heater, for example, as disclosed in U.S. Pat. No. 6,994,481 to Chi et al. Using similar operating principles to fusion splicers, these heaters create plasma from an electric discharge in air to heat the optical fibers directly.

SUMMARY OF THE INVENTION

In view of the foregoing background, it is therefore an object of the present invention to provide an optical fiber heating device that readily heats optical fibers without contamination.

This and other objects, features, and advantages in accordance with the present invention are provided by a heating device for at least one optical fiber. The heating device may comprise a crucible body having at least one optical fiber receiving slotted passageway therein for receiving the at least one optical fiber therein, and at least one heating element receiving passageway therein adjacent the at least one optical fiber receiving slotted passageway and spaced apart therefrom. The heating device may further include at least one respective electrically powered resistance heating element enclosed within the at least one heating element receiving passageway for heating the at least one optical fiber within the at least one optical fiber receiving slotted passageway. Advantageously, the at least one optical fiber is indirectly heated by radiation, conduction, and convection from the crucible body without the potential for contamination from the at least one heating element.

In some embodiments, the at least one heating element receiving passageway may extend parallel to the at least one optical fiber receiving slotted passageway. Also, in other embodiments, the at least one heating element receiving passageway may comprise a plurality of heating element receiving passageways with the at least one optical fiber receiving slotted passageway therebetween.

More particularly, the heating device may further comprise an inert gas within the at least one heating element receiving passageway. Additionally, the heating device may further comprise a respective hermetic seal between each opposing end of the at least one electrically powered resistance heating element and adjacent portions of the crucible body.

More specifically, the at least one electrically powered resistance heating element may comprise a pair of electrodes and a heating filament coupled therebetween. More so, the heating filament may comprise a spirally coiled foil strip or spirally coiled wire contacting adjacent portions of the crucible body. For example, the heating filament may comprise at least one of tungsten, platinum, rhodium, and a platinum-rhodium alloy. Also, the crucible body may comprise at least one of sapphire and polycrystalline alumina, for example.

In other embodiments, the heating device may further comprise at least one temperature sensor associated with the crucible body. And, the heating device may also comprise a heat shield surrounding the crucible body.

Another aspect is directed to a method of making a heating device for at least one optical fiber. The method may comprise forming a crucible body to have at least one optical fiber receiving slotted passageway therein for receiving the at least one optical fiber therein, and at least one heating element receiving passageway therein adjacent the at least one optical fiber receiving slotted passageway and spaced apart therefrom. The method may also include positioning at least one respective electrically powered resistance heating element enclosed within the at least one heating element receiving passageway for heating the at least one optical fiber within the at least one optical fiber receiving slotted passageway.

DETAILED DESCRIPTION OF THE PREFERRED EMBODIMENTS

Figure 1:
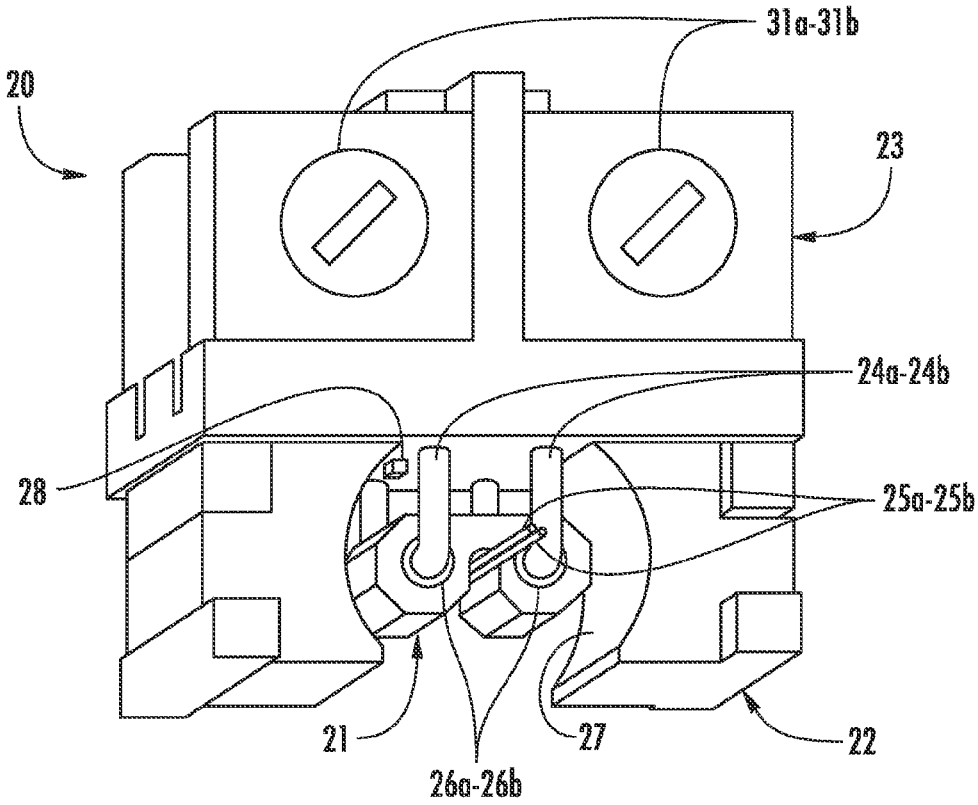
FIG. 1 is a perspective view of a heating device according to the present invention.
Figure 2:
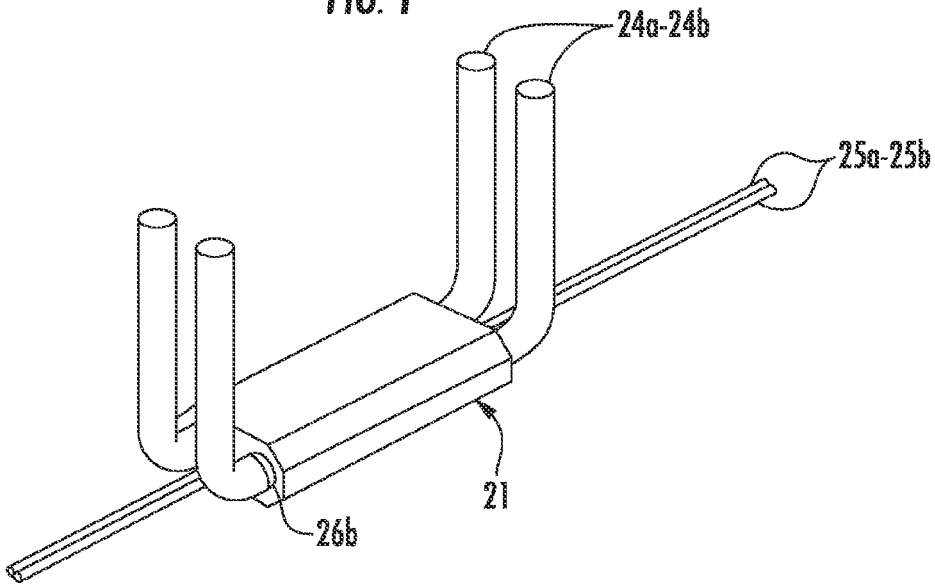
FIG. 2 is a perspective view of the heating device from FIG. 1 with the power assembly and heat shield removed, i.e. only showing the crucible body and heating elements.
Figure 3A:
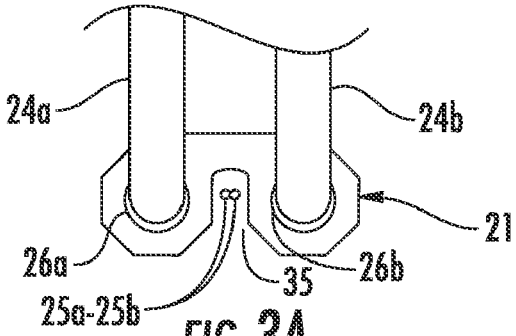
FIG. 3*a* is a side view of the crucible body and heating elements from FIG. 2.
Figure 3B:
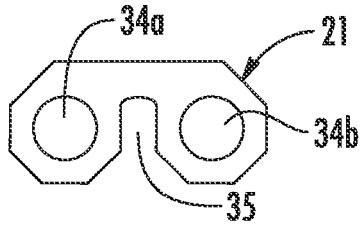
FIG. 3*b* is a side view of the crucible body from FIG. 2.
Figure 4:
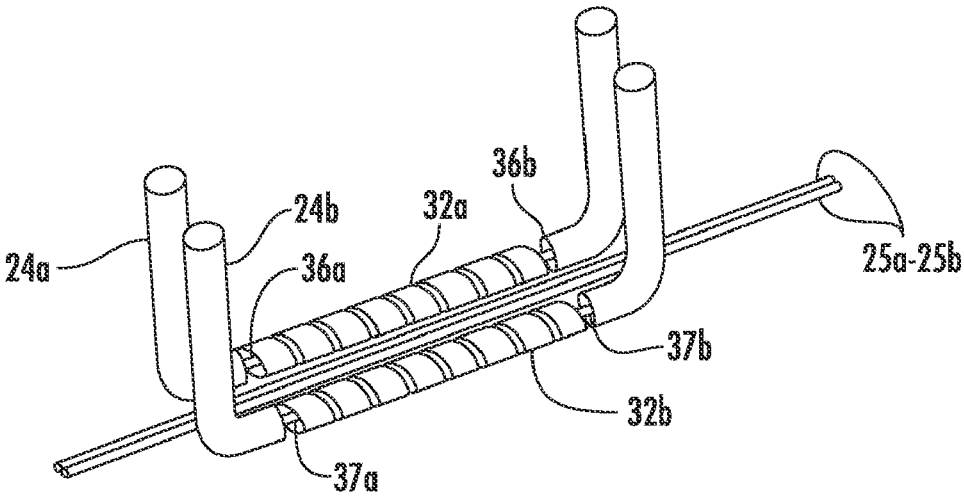
FIG. 4 is a perspective view of the heating elements from FIG. 2.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations are used to indicate similar elements in alternative embodiments.

Referring initially to FIGS. 1-4, a heating device 20 according to one embodiment is now described. As will be appreciated by those skilled in the art, the heating device 20 is for heating optical fibers to provide tapered fibers and fused couplers. For example, the optical fibers may comprise single mode or multi-mode fibers having typical dimensions, such as an outer diameter of 125 microns.

The heating device 20 illustratively receives two optical fibers 25*a*-25*b*. The heating device 20 illustratively includes a crucible body 21 having an optical fiber receiving slotted passageway 35 for receiving the optical fibers 25*a*-25*b*, the optical fiber receiving slotted passageway having a length of approximately 3 mm, for example. Of course, as will be appreciated by those skilled in the art, the appropriate length of the optical fiber receiving slotted passageway 35 may vary to better suit the desired application. The crucible body 21 illustratively includes a pair of heating element receiving passageways 34*a*-34*b* therein adjacent the optical fiber receiving slotted passageway 35 and spaced apart therefrom. The crucible body 21 may comprise a sapphire body or a polycrystalline alumina body, for example. Other materials may be used if they possess a sufficiently high melting point above the softening point of silica and are chemically inert so as not to decompose at the operating temperature in any degree that would result in the contamination of the optical fibers, as will be appreciated by those skilled in the art.

The optical fiber receiving slotted passageway 35 is positioned in between the pair of heating element receiving passageways 34*a*-34*b*, and the passageways extend parallel or substantially parallel to each other. The heating device 20 illustratively includes a corresponding pair of electrically powered resistance heating elements 24*a*-24*b* enclosed within the heating element receiving passageways 34*a*-34*b* for heating the optical fibers 25*a*-25*b* within the optical fiber receiving slotted passageway 35.

More specifically, the electrically powered resistance heating elements 24*a*-24*b* each illustratively includes a pair of electrodes 36*a*-36*b*, 37*a*-37*b* and a heating filament coupled therebetween. In the illustrated embodiment, each of the heating filaments comprises a spirally coiled foil strip 32*a*-32*b*. The electrodes 36*a*-36*b*, 37*a*-37*b* may be mechanically and electrically coupled to the filament using several methods, for example, a folded wire and tube clamp method, a split wire and ring clamp method, an electron beam welding method, or by a brazing method. The method for connection is dependent on the material used for the filament. For platinum, rhodium, and platinum-rhodium alloys, the brazing method is effective. For tungsten filaments, the electron-beam welding method is effective.

As will be appreciated by those skilled in the art, motorized tooling may be used to form the spirally coiled foil strip filament 32*a*-32*b*. Advantageously, this provides for precise spacing, and good uniformity and structural integrity in the filament 32*a*-32*b*. The distance between each spiral is advantageously small but large enough to maintain electrical isolation between turns. In other embodiments (FIG. 15), the filament may comprise spirally coiled cylindrical wire with a diameter of 60-125 microns. Helpfully, during heating operation, the spirally coiled foil strip/wire filament 32*a*-32*b* experiences thermal expansion and contacts adjacent portions of the crucible body 21 efficiently transferring heat between the filament and the crucible body by conduction. This may result in a smaller temperature difference between the filament and the crucible body 21, a lower filament temperature, and thus longer filament lifetime. In certain embodiments, the spirally coiled filament (both foil strip and wire embodiments) 32*a*-32*b* may be wound around a sapphire rod for enhancing structural integrity and ensuring good thermal contact with the crucible body 21. For example, the heating filament may comprise at least one of tungsten, platinum, rhodium, and a platinum-rhodium alloy.

Additionally, the heating device 20 illustratively includes a respective hermetic seal 26*a*-26*b* between each opposing end of the electrically powered resistance heating elements 24*a*-24*b* and adjacent portions of the crucible body 21. Further, the heating device 20 illustratively includes an inert gas (for example, argon) sealed within the heating element receiving passageways 34*a*-34*b*. Advantageously, the service life of the heating filaments may be extended, particularly in tungsten filament embodiments, since the effects of oxidation are mitigated. In other embodiments, the heating device 20 may include alumina adhesive sealed within the heating element receiving passageways 34*a*-34*b* for preventing movement of the spirally coiled foil strip 32*a*-32*b* and providing good thermal contact with the crucible body 21.

The heating device 20 illustratively includes a housing 22, and a power assembly 23 carried by the housing. The power assembly 23 illustratively includes a set of four screws 31*a*-31*d* (two screws not shown) for affixing wires (not shown) from an external power source. Of course, the illustrated screws 31*a*-31*d* are exemplary and other methods can also be used, for example, spring clamps and flexure clamps. Also, the heating device 20 illustratively includes a heat shield 27 surrounding the crucible body, the inner surface thereof being coated with a heat reflective material, for example, gold or platinum, and being carried by the housing 22. In other embodiments, a thin sheet of reflective material could be attached to the inner surface of the heat shield 27. The body of the heat shield 27 may be made of a machinable ceramic, such as Macor, for example. Advantageously, the surface of the heat shield 27 reflects and concentrates the heat emitted from the electrically powered resistance heating elements 24*a*-24*b* and the crucible body 21 for application to the optical fibers 25*a*-25*b*, thereby reducing overall energy consumption and improving efficiency. The heat shield 27 also may increase filament lifetime because the improved thermal efficiency enables fiber fusion to occur at a lower filament temperature than in a configuration where the heat shield 27 is not present.

Furthermore, the heating device 20 illustratively includes a temperature sensor 28 associated with the crucible body 21, i.e. illustratively coupled to the external surface of the housing 22. The temperature sensor 28 may comprise, for example, a thermocouple or a pyrometer. The heating device may comprise a controller (not shown) for managing the applied electrical current for the electrically powered resistance heating elements 24*a*-24*b* and for cooperating with the temperature sensor 28 to provide a closed loop system.

Another aspect is directed to a method of making a heating device 20 for at least one optical fiber 25*a*-25*b*. The method comprises forming a crucible body 21 to have at least one optical fiber receiving slotted passageway 35 therein for receiving the at least one optical fiber 25*a*-25*b* therein, and at least one heating element receiving passageway 34*a*-34*d* therein adjacent the at least one optical fiber receiving slotted passageway and spaced apart therefrom. The method also includes positioning at least one respective electrically powered resistance heating element 24*a*-24*b* enclosed within the at least one heating element receiving passageway 34*a*-34*b* for heating the at least one optical fiber 25*a*-25*b* within the at least one optical fiber receiving slotted passageway 35.

Figure 5:
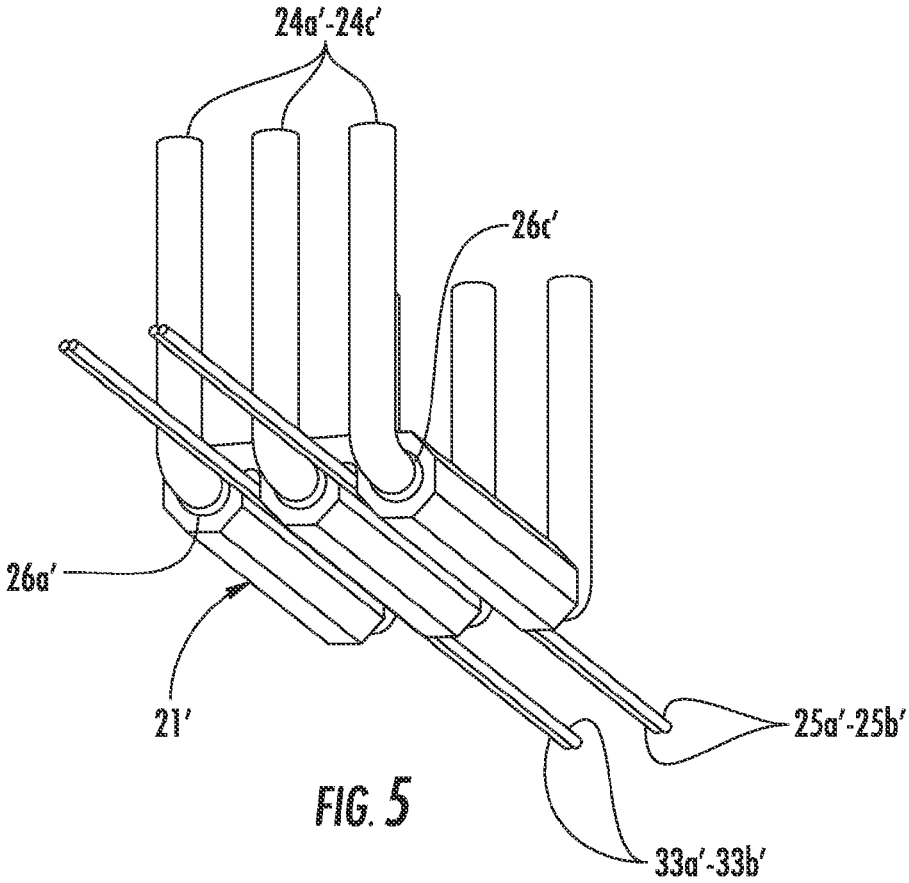
FIG. 5 is a perspective view of another embodiment of the heating device according to the present invention.
Figure 6:
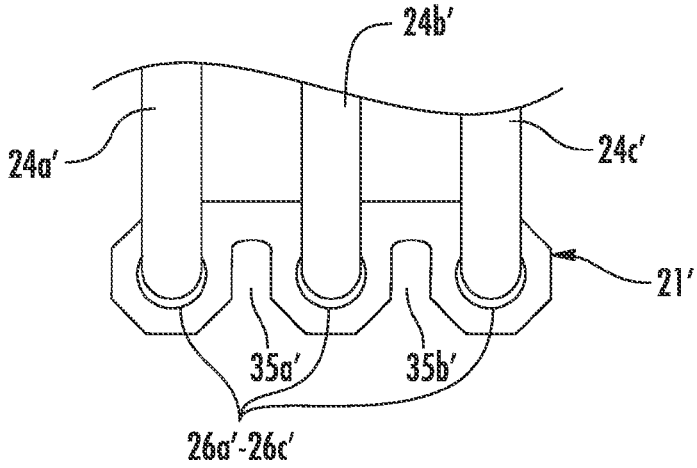
FIG. 6 is a side view of the crucible body and heating elements from FIG. 5.

Referring now to FIGS. 5-6, another embodiment of the heating device 20' is now described. In this embodiment of the heating device 20', those elements already discussed above with respect to FIGS. 1-4 are given prime notation and most require no further discussion herein. This embodiment differs from the previous embodiment in that the crucible body 21' includes a pair of optical fiber receiving slotted passageways 35*a*'-35*b*' between three heating element receiving passageways. Advantageously, the heating device 20' is readily scalable for illustratively receiving two pairs of optical fibers 25*a*'-25*b*', 33*a*'-33*b*'. In other embodiments, the heating device 20' may be expanded to include even more optical fiber receiving slotted passageways. Indeed, in embodiments also including a controller and multiple temperature sensors (not shown) in each optical fiber receiving slotted passageway 35*a*'-35*b*', the temperature in each of the optical fiber receiving slotted passageways may be controlled individually.

Figure 7:
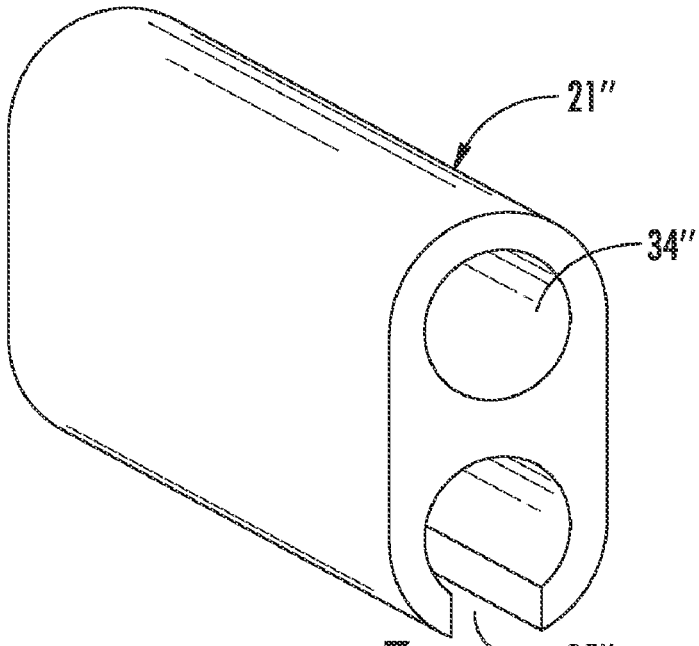
FIG. 7 is a perspective view of another embodiment of the crucible body according to the present invention.

Referring now to FIG. 7, another embodiment of the heating device 20" is now described. In this embodiment of the heating device 20", those elements already discussed above with respect to FIGS. 1-4 are given double prime notation and most require no further discussion herein. This embodiment differs from the previous embodiment in that the crucible body 21" illustratively includes an optical fiber receiving slotted passageway 35" in an opposing end of the crucible body 21" and only one heating element receiving passageway 34". Further, the crucible body 21" illustratively has rounded side portions rather than the flat side portions of the above embodiments.

Figure 8:
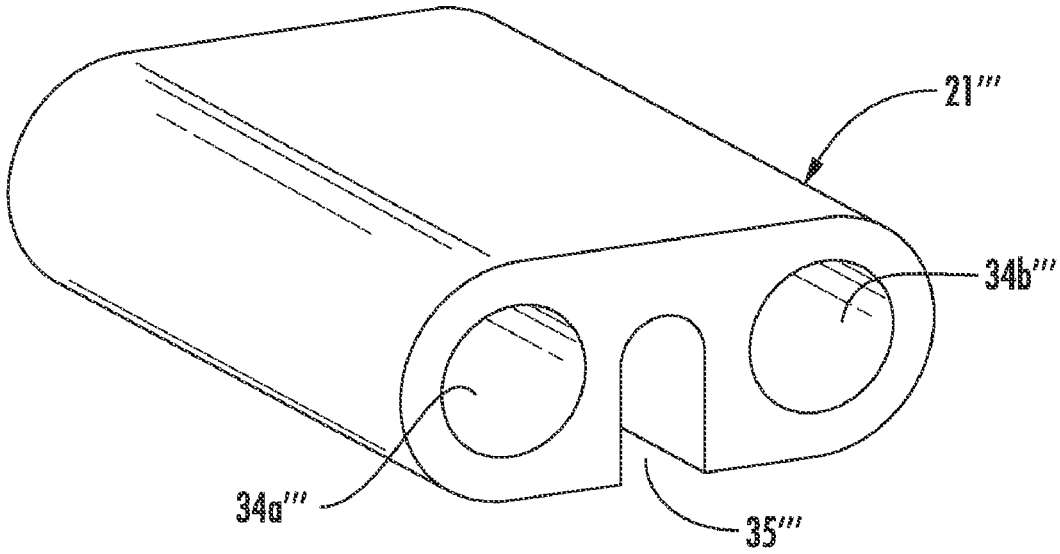
FIG. 8 is a perspective view of yet another embodiment of the crucible body according to the present invention.

Referring now to FIG. 8, another embodiment of the heating device 20''' is now described. In this embodiment of the heating device 20''', those elements already discussed above with respect to FIGS. 1-4 are given triple prime notation and most require no further discussion herein. This embodiment differs from the previous embodiment in that the crucible body 21''' illustratively has rounded side portions rather than the flat side portions of the above embodiments and the open portion of the optical fiber receiving slotted passageway 34''' does not have a flared opening.

Figure 15:
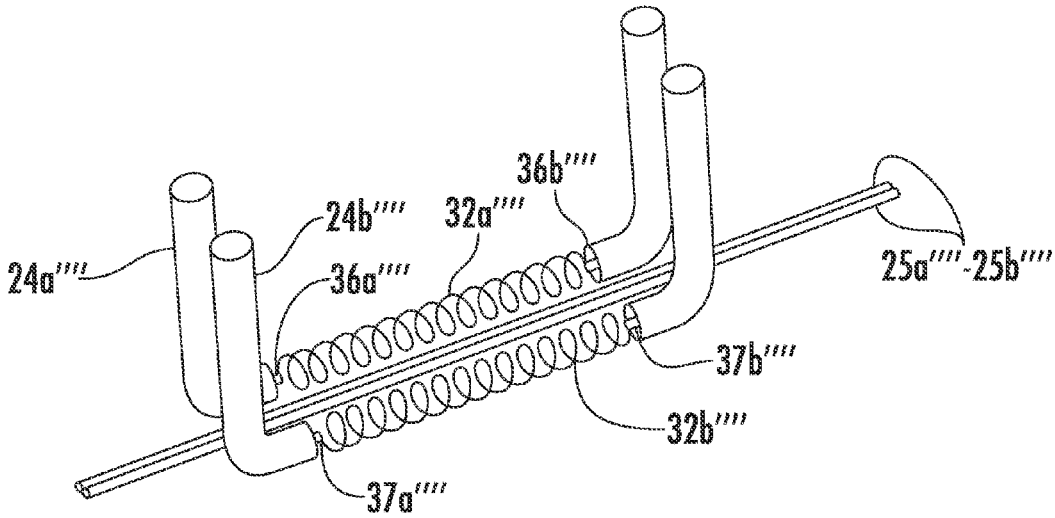
FIG. 15 is a perspective view of another embodiment of the heating elements according to the present invention.

Referring now briefly to FIG. 15, another embodiment of the heating device 20'''' is now described. In this embodiment of the heating device 20''', those elements already discussed above with respect to FIGS. 1-4 are given quadruple prime notation and most require no further discussion herein. This embodiment differs from the previous embodiment in that each of the heating filaments comprises a spirally coiled wire 32*a*''''-32*b*''''. In other embodiments, each of the heating filaments may comprise a rod for winding the spirally coiled wire 32*a*''''-32*b*'''' around.

Figure 9:
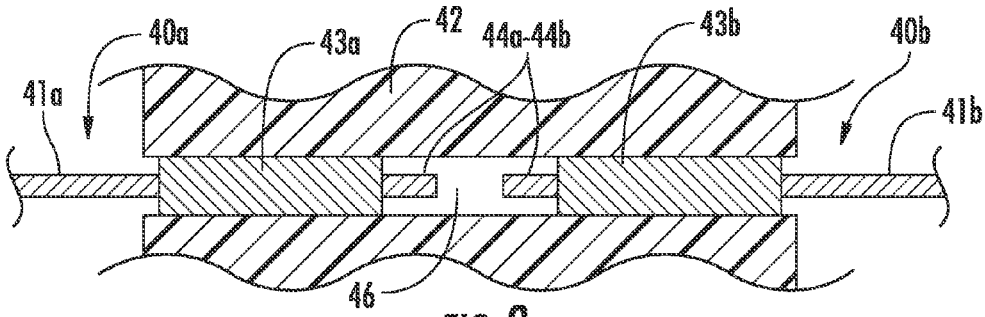
FIG. 9 is a cross-sectional view of a portion of the crucible body and heating elements of another embodiment of the heating device according to the present invention.

Referring now to FIG. 9, another embodiment of the heating device 20 is now described. This embodiment of the heating device 20 is similar to the embodiment discussed above with respect to FIGS. 1-4 and includes many of the same features. Although partially illustrated, the crucible body 42 has a similar shape and form to the crucible body 21 discussed above. This embodiment differs from the previous embodiment in that the electrically powered heating elements 40*a*-40*b* are plasma based rather than resistance based, as in the above embodiments.

In the illustrated embodiment, the electrically powered plasma heating elements 40*a*-40*b* each comprises a pair of spaced apart electrodes 44*a*-44*b* defining an electrical discharge gap 46 therebetween. For example, each of the spaced apart electrodes 44*a*-44*b* may comprise at least one of tungsten, platinum, rhodium, and a platinum-rhodium alloy. Also, the electrically powered plasma heating elements 40*a*-40*b* each comprises solid end portions 41*a*-41*b*. The electrically powered plasma heating elements 40*a*-40*b* each further comprises a connector portion 43*a*-43*b* coupling the electrodes 44*a*-44*b* and the solid end portions 41*a*-41*b* together. In this embodiment, each electrically powered plasma heating element 40*a*-40*b* may include a hermetic seal between the connector portions 43*a*-43*b* and adjacent portions of the crucible body 42 to seal the inert gas within the discharge gap 46 and maintain constant operating pressure and atmosphere within the heating element receiving passageways 34*a*-34*b*, regardless of changes in external atmospheric pressure or composition.

Figure 10:
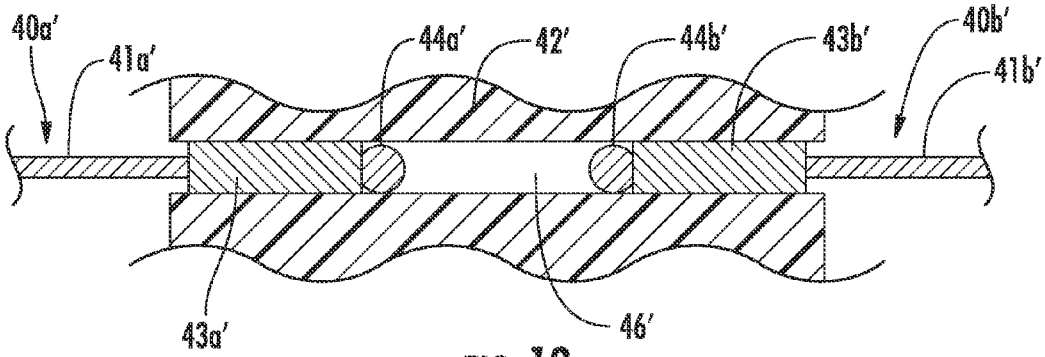
FIG. 10 is a cross-sectional view of a portion of the crucible body and heating elements of another embodiment of the heating device according to the present invention.

Referring now to FIG. 10, another embodiment of the heating device 20 is now described. In this embodiment of the heating device 20, those elements already discussed above with respect to FIG. 9 are given prime notation and most require no further discussion herein. This embodiment differs from the previous embodiment in that the electrodes 44*a*'-44*b*' are sphere-shaped. Advantageously, during operation, if the sphere-shaped electrodes 44*a*'-44*b*' melt, at this order of size (electrode 44*a*'-44*b*' diameter size is approximately 900 microns), the electrodes maintain their sphere shape due to surface tension. In another embodiment (not shown), the electrodes 44*a*'-44*b*' may be cone-shaped.

Figure 11:
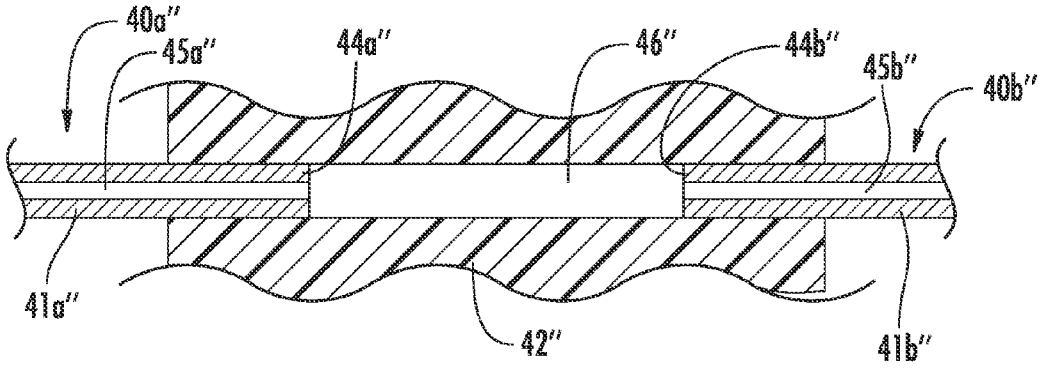
FIG. 11 is a cross-sectional view of a portion of the crucible body and heating elements of yet another embodiment of the heating device according to the present invention.

Referring now to FIG. 11, another embodiment of the heating device 20 is now described. In this embodiment of the heating device 20, those elements already discussed above with respect to FIG. 9 are given double prime notation and most require no further discussion herein. This embodiment differs from the previous embodiment in that the electrically powered plasma heating elements 40*a*"-40*b*" each comprises tubular end portions 41*a*"-41*b*" extending into the heating element receiving passageways and defining a space 45*a*"-45*b*" therein. In the illustrated embodiment, the tubular end portions 41*a*"-41*b*" serve as the electrodes for generating the plasma arc in the discharge gap 46". Nonetheless, in other embodiments, filament or spherical electrodes could be affixed to the tubular end portions 41*a*"-41*b*". Advantageously, an inert gas may be passed through the tubular end portions 41*a*"-41*b*" to purge the discharge gap 46" of oxygen, i.e. this embodiment does not include a hermetic seal between the tubular end portions and adjacent portions of the crucible body 42". As will be readily appreciated by those skilled in the art, the tubular end portions may be used in the above described filament embodiments, particularly, in tungsten filament embodiments (FIGS. 1-4).

Another aspect is directed to a method of making a heating device 20 for at least one optical fiber 25*a*-25*b*. The method includes forming a crucible body 42 to have at least one optical fiber receiving slotted passageway 35 therein for receiving the at least one optical fiber 25*a*-25*b* therein, and at least one heating element receiving passageway 34*a*-34*b* therein adjacent the at least one optical fiber receiving slotted passageway and spaced apart therefrom. The method also includes positioning at least one respective electrically powered plasma heating element 40*a*-40*b* enclosed within the at least one heating element receiving passageway 34*a*-34*b* for heating the at least one optical fiber 25*a*-25*b* within the at least one optical fiber receiving slotted passageway 35.

Advantageously, the above discussed heating device 20 avoids many of the potential drawbacks of the prior art heating devices. For example, the heating device 20 avoids drawbacks of prior art flame based optical fiber heaters, including, for example, instability from atmospheric changes, lack of thermal capacitance exposing optical fiber to rapid changes in temperature and creating residual stresses on the optical fiber, combustion byproducts interfering with performance and increasing loss due to deposition on coupler surface or diffusion therein, and difficulty in removing combustion byproducts from the work environment.

Also, the heating device 20 avoids potential drawbacks of prior art laser based optical fiber heaters, including, for example, large and expensive hardware for producing and directing the laser beam and difficulty in controlling the laser during tapering operations. The heating device 20 avoids potential drawbacks of prior art tungsten filament based optical fiber heaters, including, for example, reduced life cycle for the tungsten filament and optical fiber contamination from oxidized and evaporated tungsten.

The heating device 20 avoids potential drawbacks of prior art platinum filament or platinum crucible based optical fiber heaters, including, for example, low melting point of platinum preventing use in high temperature fused couplers, and platinum deposition on the fused coupler due to the direct exposure of the optical fibers to the heated platinum reducing performance.

The heating device 20 avoids potential drawbacks of prior art molybdenum disilicide electric resistance optical fiber heaters including: relatively large size due to the fact that molybdenum disilicide is a brittle ceramic that cannot be readily formed into a sub-millimeter diameter filament; increasing/decreasing the temperature within the crucible in steps since the molybdenum disilicide heating elements are sensitive to thermal shock and residual stresses created by rapid cooling/heating; and a reduced life cycle since the heating element may react with the refractory material encasing the molybdenum disilicide when operated above the melting point of silica.

The heating device 20 avoids potential drawbacks of prior art plasma based optical fiber heaters that heat fibers by directly exposing them to the plasma, including, for example: problems controlling temperature distribution since the arc may wander as electrodes age, sensitivity to atmospheric conditions such as atmospheric pressure, and oxidization and other debris from electrodes contaminating the optical fibers.

The heating device 20 indirectly heats the optical fibers 25*a*-25*b* without the contamination problem of the prior art. Further, the heating device 20 may seal the filament 32*a*-32*b* and/or electrodes 44*a*-44*b* (plasma heating element embodiments) in an inert gas to reduce the effects of oxidation, increasing the service life of the heating device 20 and making the heating device relatively immune to changes in atmospheric conditions. Moreover, the yield of the tapered and fused optical fibers produced with the heating device 20 is anticipated to be increased over that of the prior art since there are fewer contaminates in the finished silica product and since the heat applied across the optical fiber receiving slotted passageway 35 is less subject to variation than the typical hydrogen or deuterium flame based heater due to the thermal capacity of the crucible. Moreover, in the electrically powered plasma heating element embodiments, the crucible body 21 provides excellent heat distribution and prevents arc wander from affecting the optical fibers 25*a*-25*b*.

Figure 12:
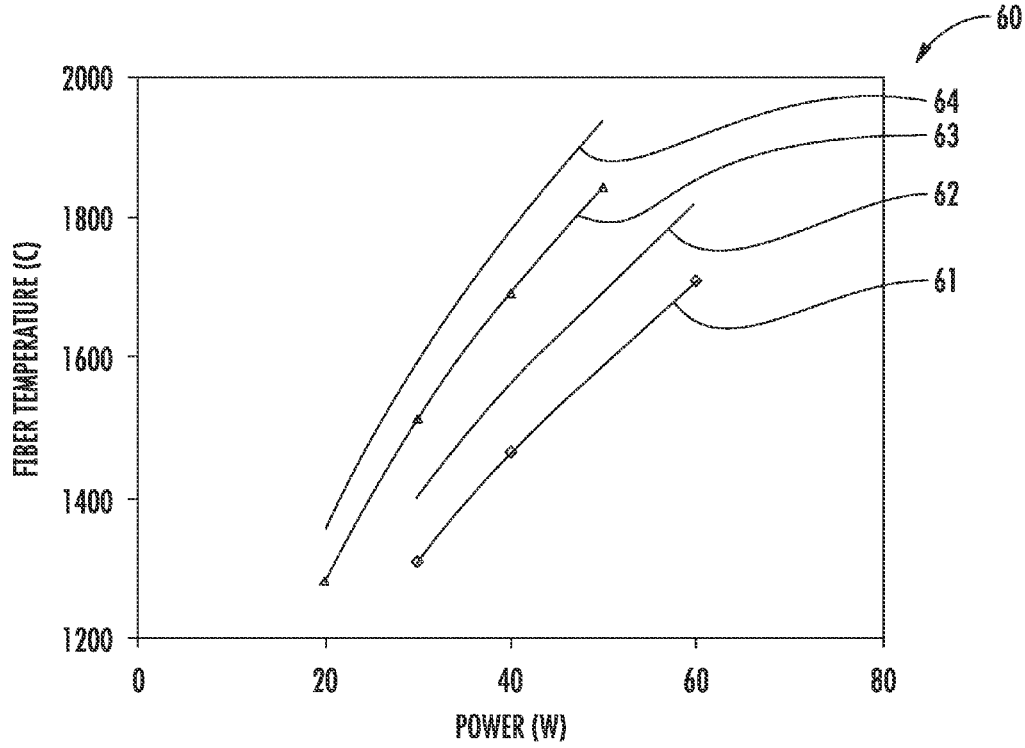
FIG. 12 is a graph of simulated optical fiber temperature versus applied power in the heating device according to the present invention.
Figure 13:
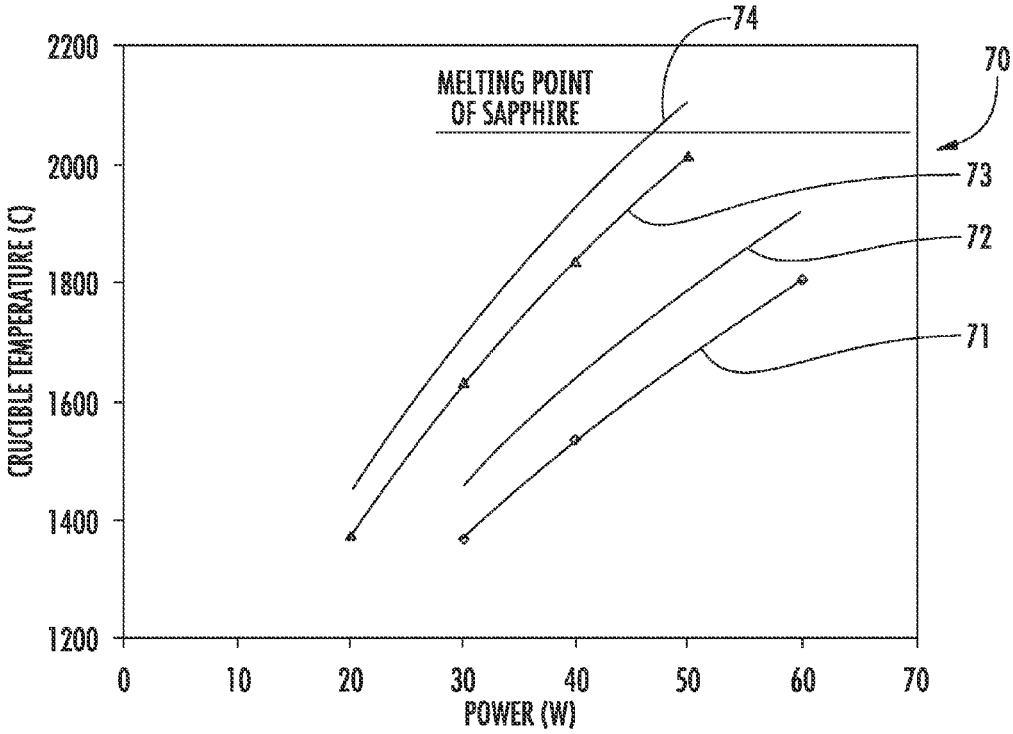
FIG. 13 is a graph of simulated crucible temperature versus applied power in the heating device according to the present invention.
Figure 14:
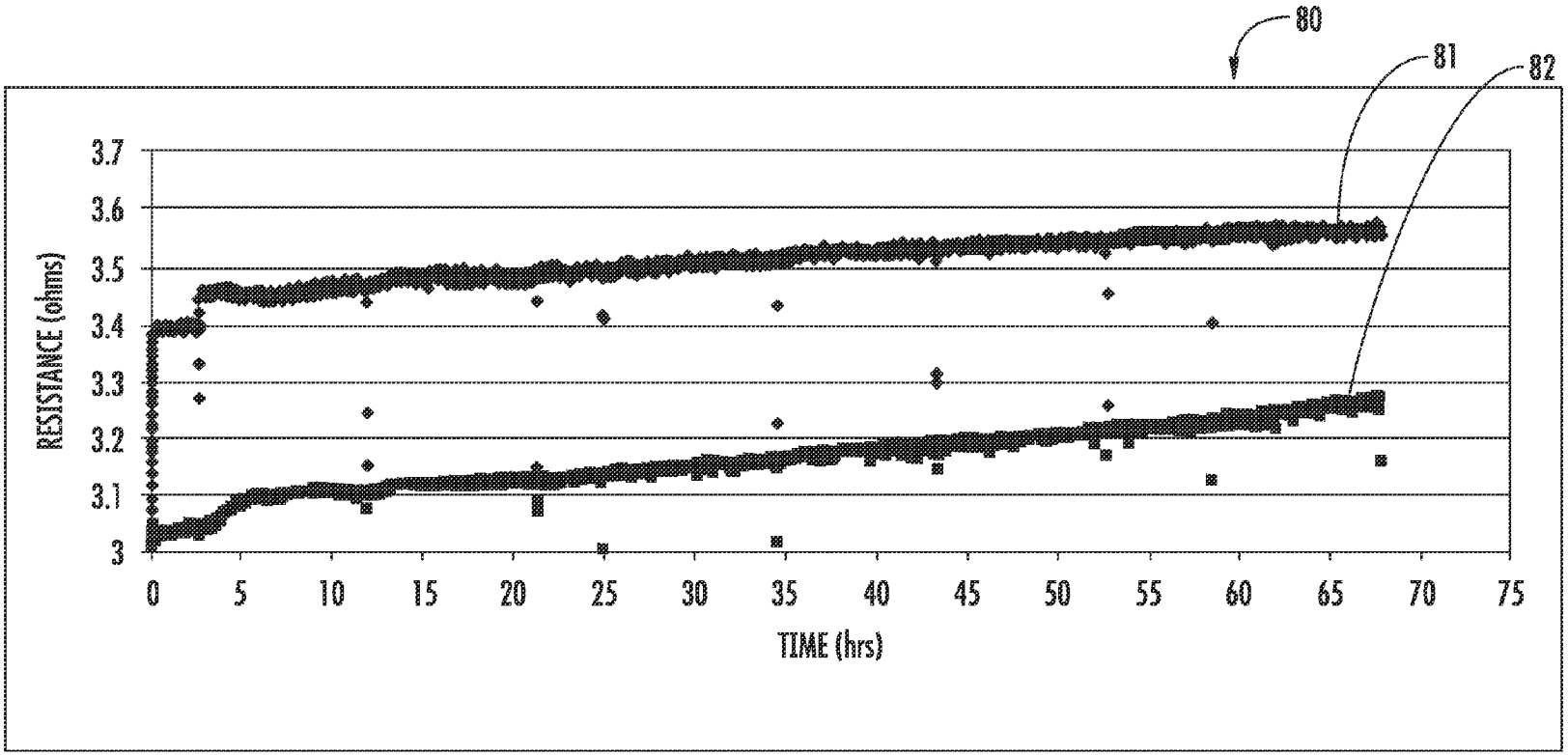
FIG. 14 is a graph of heating element resistance versus service life in the heating device according to the present invention.

Referring now to FIGS. 12-14, the simulation and test results of an exemplary prototype heating device according to the present disclosure are now described. A diagram 60 shows the simulated temperature of the optical fibers 25*a*-25*b* versus total applied power to the electrically powered resistance heating elements 24*a*-24*b* in the heating device 20. The diagram 60 includes curves 63 and 61 showing the temperature of the optical fibers 25*a*-25*b* with the heat shield 27 removed in short crucible length (3.8 mm) and long crucible length (7.6 mm) embodiments, respectively. The diagram 60 includes curves 64 and 62 showing the temperature of the optical fibers 25*a*-25*b* with the heat shield 27 installed in short crucible length and long crucible length embodiments, respectively. The diagram 60 shows that a prescribed fiber temperature can be obtained at a lower element power level when the heat shield 27 is utilized around the crucible (compare curves 61 and 62).

Another diagram 70 shows the temperature of the crucible body 21 versus total applied power to the electrically powered resistance heating elements 24*a*-24*b* in the heating device 20. The diagram 70 includes curves 73 and 71 showing the temperature of the crucible body 21 with the heat shield 27 removed in short crucible length and long crucible length embodiments, respectively. The diagram 70 includes curves 74 and 72 showing the temperature of the crucible body 21 with the heat shield 27 installed in short crucible length and long crucible length embodiments, respectively.

As shown in the diagrams 60, 70, the temperature of the crucible body 21 and the optical fibers 25*a*-25*b* closely align, indicating efficient thermal energy transfer. Yet another diagram 80 shows the resistance of each of the electrically powered resistance heating elements 24*a*-24*b* versus service life in hours. For this test, the heating elements 24*a*-24*b* were enclosed in individual sapphire tubes rather than the prototype crucible heating device and the tubes were not hermetically sealed. This diagram 80 illustratively includes curves 81 and 82 showing performance of the electrically powered resistance heating elements 24*a*-24*b*. As shown in the diagram 80, the electrically powered resistance heating elements 24*a*-24*b* of the heating device 20 exhibit consistent performance over a lengthy service life with longer life being possible from a hermetically sealed crucible heating device.

Other features relating to optical fiber heating devices are disclosed in co-pending applications "PLASMA HEATING DEVICE FOR AN OPTICAL FIBER AND RELATED METHODS", Ser. No. 12/545,620; and "TAPERED OPTICAL FIBERS", U.S. patent application Ser. No. 11/473,689 to Harper et al., all of which are assigned to the present application's assignee and are incorporated herein by reference in their entirety.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A heating device for at least one optical fiber comprising:

a crucible body having at least one optical fiber receiving slotted passageway therein configured to receive the at least one optical fiber therein, and at least one heating element receiving passageway therein adjacent the at least one optical fiber receiving slotted passageway and spaced apart therefrom;

at least one respective electrically powered resistance heating element enclosed within the at least one heating element receiving passageway and configured to heat the at least one optical fiber within the at least one optical fiber receiving slotted passageway; and an inert gas within said at least one heating element receiving passageway.

2. The heating device according to claim 1 wherein the at least one heating element receiving passageway extends parallel to the at least one optical fiber receiving slotted passageway.

3. The heating device according to claim 1 wherein the at least one heating element receiving passageway comprises a plurality of heating element receiving passageways with the at least one optical fiber receiving slotted passageway therebetween.

4. The heating device according to claim 1 further comprising a respective hermetic seal between each opposing end of said at least one electrically powered resistance heating element and adjacent portions of said crucible body.

5. The heating device according to claim 1 wherein said at least one electrically powered resistance heating element comprises a pair of electrodes and a heating filament coupled therebetween.

6. The heating device according to claim 5 wherein said heating filament comprises a spirally coiled foil strip contacting adjacent portions of said crucible body.

7. The heating device according to claim 5 wherein said heating filament comprises a spirally coiled wire contacting adjacent portions of said crucible body.

8. The heating device according to claim 5 wherein said heating filament comprises at least one of tungsten, platinum, rhodium, and a platinum-rhodium alloy.

9. The heating device according to claim 1 wherein said crucible body comprises at least one of sapphire and polycrystalline alumina.

10. The heating device according to claim 1 further comprising at least one temperature sensor associated with said crucible body.

11. The heating device according to claim 1 further comprising a heat shield surrounding said crucible body.

12. A heating device for at least one optical fiber comprising:

a crucible body having an optical fiber receiving slotted passageway therein for receiving the at least one optical fiber therein, and a pair of heating element receiving passageways therein adjacent and extending parallel to the optical fiber receiving slotted passageway and spaced apart therefrom on opposite sides thereof;

a respective electrically powered resistance heating element enclosed within each of the heating element receiving passageways and configured to heat the at least one optical fiber within the optical fiber receiving slotted passageway; and an inert gas within each heating element receiving passageway.

13. The heating device according to claim 12 further comprising a respective hermetic seal between each opposing end of each of said electrically powered resistance heating elements and adjacent portions of said crucible body.

14. The heating device according to claim 12 wherein each of said electrically powered resistance heating elements comprises a pair of electrodes and a heating filament coupled therebetween.

15. The heating device according to claim 14 wherein said heating filament comprises a spirally coiled foil strip contacting adjacent portions of said crucible body.

16. The heating device according to claim 14 wherein said heating filament comprises a spirally coiled wire contacting adjacent portions of said crucible body.

17. A heating device for at least one optical fiber comprising:

a crucible body having at least one optical fiber receiving slotted passageway therein for receiving the at least one optical fiber therein, and at least one heating element receiving passageway therein adjacent the at least one optical fiber receiving slotted passageway and spaced apart therefrom;

at least one respective electrically powered resistance heating element enclosed within the at least one heating element receiving passageway and configured to heat the at least one optical fiber within the at least one optical fiber receiving slotted passageway; and a respective hermetic seal between each opposing end of said at least one electrically powered resistance heating element and adjacent portions of said crucible body.

18. The heating device according to claim 17 wherein said at least one electrically powered resistance heating element comprises a pair of electrodes and a heating filament coupled therebetween.

19. The heating device according to claim 17 wherein the at least one heating element receiving passageway comprises a plurality of heating element receiving passageways with the at least one optical fiber receiving slotted passageway therebetween.

20. A heating device for at least one optical fiber comprising:

a crucible body having at least one optical fiber receiving slotted passageway therein for receiving the at least one optical fiber therein, and at least one heating element receiving passageway therein adjacent the at least one optical fiber receiving slotted passageway and spaced apart therefrom; and at least one respective electrically powered resistance heating element enclosed within the at least one heating element receiving passageway and comprising a pair of electrodes and a heating filament coupled therebetween, said heating filament comprising a spirally coiled foil strip contacting adjacent portions of said crucible body;

said at least one respective electrically powered resistance heating element configured to heat the at least one optical fiber within the at least one optical fiber receiving slotted passageway.

21. The heating device according to claim 20 wherein said at least one electrically powered resistance heating element comprises a pair of electrodes and a heating filament coupled therebetween.

22. The heating device according to claim 20 wherein the at least one heating element receiving passageway comprises a plurality of heating element receiving passageways with the at least one optical fiber receiving slotted passageway therebetween.

23. A heating device for at least one optical fiber comprising:

a crucible body having at least one optical fiber receiving slotted passageway therein for receiving the at least one optical fiber therein, and at least one heating element receiving passageway therein adjacent the at least one optical fiber receiving slotted passageway and spaced apart therefrom;

at least one respective electrically powered resistance heating element enclosed within the at least one heating element receiving passageway and configured to heat the at least one optical fiber within the at least one optical fiber receiving slotted passageway; and a heat shield surrounding said crucible body.

24. The heating device according to claim 23 wherein said at least one electrically powered resistance heating element comprises a pair of electrodes and a heating filament coupled therebetween.

25. The heating device according to claim 23 wherein the at least one heating element receiving passageway comprises a plurality of heating element receiving passageways with the at least one optical fiber receiving slotted passageway therebetween.

26. A method of making a heating device for at least one optical fiber, the method comprising:

forming a crucible body to have at least one optical fiber receiving slotted passageway therein for receiving the at least one optical fiber therein, and at least one heating element receiving passageway therein adjacent the at least one optical fiber receiving slotted passageway and spaced apart therefrom;

positioning at least one respective electrically powered resistance heating element enclosed within the at least one heating element receiving passageway for heating the at least one optical fiber within the at least one optical fiber receiving slotted passageway; and inserting an inert gas within the at least one heating element receiving passageway.

27. The method according to claim 26 wherein forming the crucible body includes forming the at least one heating element receiving passageway to extend parallel to the at least one optical fiber receiving slotted passageway.

28. The method according to claim 26 wherein forming the crucible body includes forming a plurality of heating element receiving passageways with the at least one optical fiber receiving slotted passageway therebetween.

29. The method according to claim 26 further comprising forming a respective hermetic seal between each opposing end of the at least one electrically powered resistance heating element and adjacent portions of the crucible body.

30. The method according to claim 26 further comprising positioning at least one temperature sensor associated with the crucible body.

31. The method according to claim 26 further comprising positioning a heat shield surrounding the crucible body.

32. A method of making a heating device for at least one optical fiber, the method comprising:

forming a crucible body to have at least one optical fiber receiving slotted passageway therein for receiving the at least one optical fiber therein, and at least one heating element receiving passageway therein adjacent the at least one optical fiber receiving slotted passageway and spaced apart therefrom;

positioning at least one respective electrically powered resistance heating element enclosed within the at least one heating element receiving passageway for heating the at least one optical fiber within the at least one optical fiber receiving slotted passageway; and forming a respective hermetic seal between each opposing end of the at least one electrically powered resistance heating element and adjacent portions of the crucible body.

33. The method according to claim 32 wherein forming the crucible body includes forming the at least one heating element receiving passageway to extend parallel to the at least one optical fiber receiving slotted passageway.

34. The method according to claim 32 wherein forming the crucible body includes forming a plurality of heating element receiving passageways with the at least one optical fiber receiving slotted passageway therebetween.

35. A method of making a heating device for at least one optical fiber, the method comprising:

forming a crucible body to have at least one optical fiber receiving slotted passageway therein for receiving the at least one optical fiber therein, and at least one heating element receiving passageway therein adjacent the at least one optical fiber receiving slotted passageway and spaced apart therefrom;

positioning at least one respective electrically powered resistance heating element enclosed within the at least one heating element receiving passageway for heating the at least one optical fiber within the at least one optical fiber receiving slotted passageway; and positioning a heat shield surrounding the crucible body.

36. The method according to claim 35 wherein forming the crucible body includes forming the at least one heating element receiving passageway to extend parallel to the at least one optical fiber receiving slotted passageway.

37. The method according to claim 35 wherein forming the crucible body includes forming a plurality of heating element receiving passageways with the at least one optical fiber receiving slotted passageway therebetween.

38. A method of making a heating device for at least one optical fiber, the method comprising:

forming a crucible body to have at least one optical fiber receiving slotted passageway therein for receiving the at least one optical fiber therein, and at least one heating element receiving passageway therein adjacent the at least one optical fiber receiving slotted passageway and spaced apart therefrom; and positioning at least one respective electrically powered resistance heating element enclosed within the at least one heating element receiving passageway for heating the at least one optical fiber within the at least one optical fiber receiving slotted passageway, the at least one respective electrically powered resistance heating element comprising a pair of electrodes and a heating filament coupled therebetween, the heating filament comprising a spirally coiled foil strip contacting adjacent portions of the crucible body.

39. The method according to claim 38 wherein forming the crucible body includes forming the at least one heating element receiving passageway to extend parallel to the at least one optical fiber receiving slotted passageway.

40. The method according to claim 38 wherein forming the crucible body includes forming a plurality of heating element receiving passageways with the at least one optical fiber receiving slotted passageway therebetween.

* * * * *